US007316331B2

(12) United States Patent
Gabryszewski

(10) Patent No.: US 7,316,331 B2
(45) **Date of Patent: *Jan. 8, 2008**

(54) SOLENOID USING COLOR-CODED VISUAL INDICIA IN A LIQUID DISPENSING SYSTEM

(75) Inventor: Gregory J. Gabryszewski, Snellville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/276,372

(22) Filed: Feb. 27, 2006

(65) Prior Publication Data

US 2006/0144850 A1 Jul. 6, 2006

Related U.S. Application Data

(62) Division of application No. 10/285,199, filed on Oct. 31, 2002, now Pat. No. 7,032,789.

(51) Int. Cl.
*B67D 5/62* (2006.01)

(52) U.S. Cl. ..... 222/146.5; 222/1; 222/23; 222/504

(58) Field of Classification Search ..... 222/504, 222/146.2, 146.5, 1, 23, 25
See application file for complete search history.

(56) References Cited

U.S. PATENT DOCUMENTS

| | | | |
|---|---|---|---|
| 3,590,739 | A | 7/1971 | Persson |
| 3,662,927 | A | 5/1972 | Cocks |
| 4,039,039 | A | 8/1977 | Gottfried |
| 4,066,188 | A | 1/1978 | Scholl et al. |
| 4,488,665 | A | 12/1984 | Cocks et al. |
| 4,600,124 | A | 7/1986 | Price |
| 4,671,315 | A | 6/1987 | Gardner |
| 4,911,956 | A | 3/1990 | Gabryszewski et al. |
| 5,020,435 | A | 6/1991 | Cawte |
| 5,199,604 | A | 4/1993 | Palmer et al. |
| 5,255,682 | A | 10/1993 | Pawluskiewicz et al. |
| 5,277,344 | A | 1/1994 | Jenkins |
| 5,351,715 | A | 10/1994 | Byam |
| 5,865,419 | A | 2/1999 | Nelson et al. |
| 5,934,520 | A | 8/1999 | Byerly et al. |
| 5,937,887 | A | 8/1999 | Baxter et al. |
| 5,979,866 | A | 11/1999 | Baxter et al. |
| D418,848 | S | 1/2000 | Raterman |

(Continued)

OTHER PUBLICATIONS

InvenSys Appliance Controls, Appliance Water Valve, Jul. 1999.

(Continued)

*Primary Examiner*—Frederick C. Nicolas
(74) *Attorney, Agent, or Firm*—Wood, Herron & Evans, LLP

(57) ABSTRACT

A liquid dispensing system and methods including color-coded visual indicia to assist an operator in the proper selection of the components and in the configuration of those components in the system during setup, maintenance and diagnostics. Color-coded indicia is also provided to assist an operator in the proper selection of a solenoid for use in a particular application. Various components of the liquid dispensing system, such as the melter unit, controller, hoses, electrical cordsets and solenoid, include visually identifiable color-coded indicia on the surfaces of the components, such as color-coded rings, bands and characters, to assist the operator in the component selection and configuration processes.

8 Claims, 3 Drawing Sheets

U.S. PATENT DOCUMENTS

| | | | |
|---|---|---|---|
| D420,024 | S | 2/2000 | Raterman |
| D423,529 | S | 4/2000 | Raterman |
| 6,053,198 | A | 4/2000 | Atkin et al. |
| 6,053,212 | A | 4/2000 | Thomas |
| 6,082,627 | A | 7/2000 | Raterman |
| 6,092,390 | A | 7/2000 | Griffith, Jr. |
| 6,120,007 | A | 9/2000 | Grant |
| D433,692 | S | 11/2000 | Fort et al. |
| D434,053 | S | 11/2000 | Fort et al. |
| D434,784 | S | 12/2000 | Raterman |
| 6,322,242 | B1 | 11/2001 | Lang et al. |
| 6,325,297 | B1 | 12/2001 | Calvin et al. |
| 6,527,143 | B1 | 3/2003 | Schomacker |
| 6,611,203 | B2 | 8/2003 | Whitmore et al. |
| 6,612,619 | B2 | 9/2003 | Wieder |
| 6,669,111 | B2 | 12/2003 | Vinson et al. |
| 6,883,684 | B2 | 4/2005 | Jeter et al. |
| 7,032,789 | B2 * | 4/2006 | Gabryszewski ..... 222/504 |

OTHER PUBLICATIONS

Nordson Corporation, Nordson Electro-Pneumatic Solenoid Valves, 1996 Adhesives and Sealants Equipment Catalog, p. 13-5 (1 page).

* cited by examiner

SOLENOID USING COLOR-CODED VISUAL INDICIA IN A LIQUID DISPENSING SYSTEM

This application is a divisional of U.S. patent application Ser. No. 10/285,199, filed Oct. 31, 2002, now U.S. Pat. No. 7,032,789 the disclosure of which is hereby incorporated herein by reference in its entirety.

FIELD OF THE INVENTION

The present invention relates generally to liquid dispensing systems for dispensing liquid materials such as hot melt adhesives, sealants and caulking and, more particularly, to manners of providing visual identification of the components of such liquid dispensing systems.

BACKGROUND OF THE INVENTION

Liquid dispensing systems are used in a variety of industrial applications. For example, in the case of hot melt adhesive dispensing systems, heated liquid adhesive is conveyed through an elongated heated hose from a melter unit having a hot melt supply tank, heated manifold and pump to a remote hot melt dispensing gun. The dispensing gun receives molten hot melt adhesive from the melter unit through the heated hose. In some applications, multiple dispensing guns are connected to a single melter unit through a set of hoses with each hose being connected to a different dispensing gun.

Each dispensing gun and hose, as well as parts of the melter unit, includes a separate heater which must be operated within a predetermined temperature range to provide the proper viscosity for the particular hot melt adhesive used in the dispensing application. To monitor the temperature of the hot melt adhesive throughout the dispensing system, each component includes a temperature sensor which is electrically coupled to a controller of the system. The controller senses the temperature within each component through the respective temperature sensors and operates the heaters within the melter unit, hose and dispensing gun to maintain the hot melt adhesive within the predetermined temperature range.

Dispensing guns in operation, such as those used in packaging or diaper manufacturing lines, are typically located remote from the melter unit. For example, one dispensing gun may be located relatively close to the melter unit (i.e., four (4) feet, for example) while other guns maybe located at various distances from the melter unit (i.e., eight (8), ten (10) and twelve (12) feet, for example). The distance of the guns from the melter unit can cause significant problems when the line is being setup or during diagnostics and maintenance of the dispensing system by an operator. In particular, hoses are traditionally monochrome in color, with a vast majority of them being completely black. When a line is being setup, it is often difficult and time consuming for an operator to select the correct length of hose for each gun to ensure that each hose will have a sufficient length, without excessive slack, to reach its associated gun from the melter unit. The same problem occurs during maintenance and diagnostics when the ends of the hoses are disconnected from either the melter unit, the guns, or both. The operator must then determine which hoses are to be connected to the various guns of the system which can cause the system to operate improperly if the hoses are not reconnected in their proper positions.

In addition, care must be taken when selecting and connecting hoses between the melter unit and the guns since the temperature sensing devices within the hose and gun must be compatible with the controller of the system. For example, one particular temperature sensing device commonly used in the melter unit, hoses and guns is a resistance temperature detector (RTD) which may be made from different materials, such as nickel or platinum. A nickel RTD must be connected to a controller compatible with a nickel RTD, while a platinum RTD will only work properly with a controller compatible with a platinum RTD. If the RTD type of the hose and gun is not properly matched to the appropriate, material-specific controller, the controller may provide erroneous temperature information about the hot melt adhesive in the hose and gun and may cause the heating devices within these components to operate improperly.

A still further complication in proper setup and maintenance of the dispensing system is caused by the need for proper selection of a solenoid to control operation of solenoid-operated dispensing guns. For example, with pneumatic guns operated by a pressurized air controlled through operation of a solenoid, such as the pneumatic dispensing gun fully disclosed in U.S. Pat. Nos. 4,066,188, 5,277,344 and 5,934,520, owned by the present assignee and the disclosures of which are hereby incorporated herein by reference in their entirety, the solenoid is connected to a source of pressurized air to control actuation of a pneumatically-controlled valve within the gun. Each solenoid has a particular air volume capacity rating, voltage requirement and/or temperature rating which must be properly selected by the operator to meet the specific application needs. Improper selection of the solenoid may result in failure of the dispensing gun to provide the desired pattern of hot melt adhesive on the substrate. This can lead to significant downtime of the dispensing line.

For reasons such as those described above, it would be desirable to provide components of a liquid dispensing system that assist an operator in the proper selection of the components and in the configuration of those components in the system during setup, maintenance and diagnostics. It would also be desirable to assist an operator in the proper selection of a solenoid for use in a particular liquid dispensing application.

SUMMARY OF THE INVENTION

The present invention overcomes the foregoing and other shortcomings and drawbacks of manners of providing visual identification of the components of a liquid dispensing system heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a liquid dispensing system is provided having visually identifiable color-coded indicia on components of the dispensing system to assist an operator in the proper selection of the components and in the configuration of those components in the system during setup, maintenance and diagnostics.

The liquid dispensing system includes a melter unit for holding a supply of hot melt adhesive and heated dispensers or guns for dispensing hot melt adhesive supplied from the melter unit. The melter unit includes a hot melt supply tank, heated manifold and pump. The hot melt adhesive, in a suitable molten condition, is supplied from the melter unit to the dispensing guns through heated hoses and is dispensed through dispensing orifices of the guns.

In accordance with the principles of the present invention, a solenoid of the liquid dispensing system is provided with visually identifiable color-coded indicia which corresponds to operating characteristics of the solenoid. In one embodiment of the present invention, the solenoid comprises a solenoid used with a pneumatic gun having color-coded indicia which corresponds to an air volume rating of the solenoid and another different color-coded indicia corresponding to a voltage requirement and/or temperature rating of the solenoid for a particular application. In this way, the color-coded indicia assists an operator in the proper selection of a solenoid for use in the liquid dispensing system based on its operating characteristics. The color-coded indicia may be used with other types of liquid dispensing guns, including electric guns, so that the color-coded indicia corresponds to operating characteristics of the solenoid used with a particular type of liquid dispensing gun.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
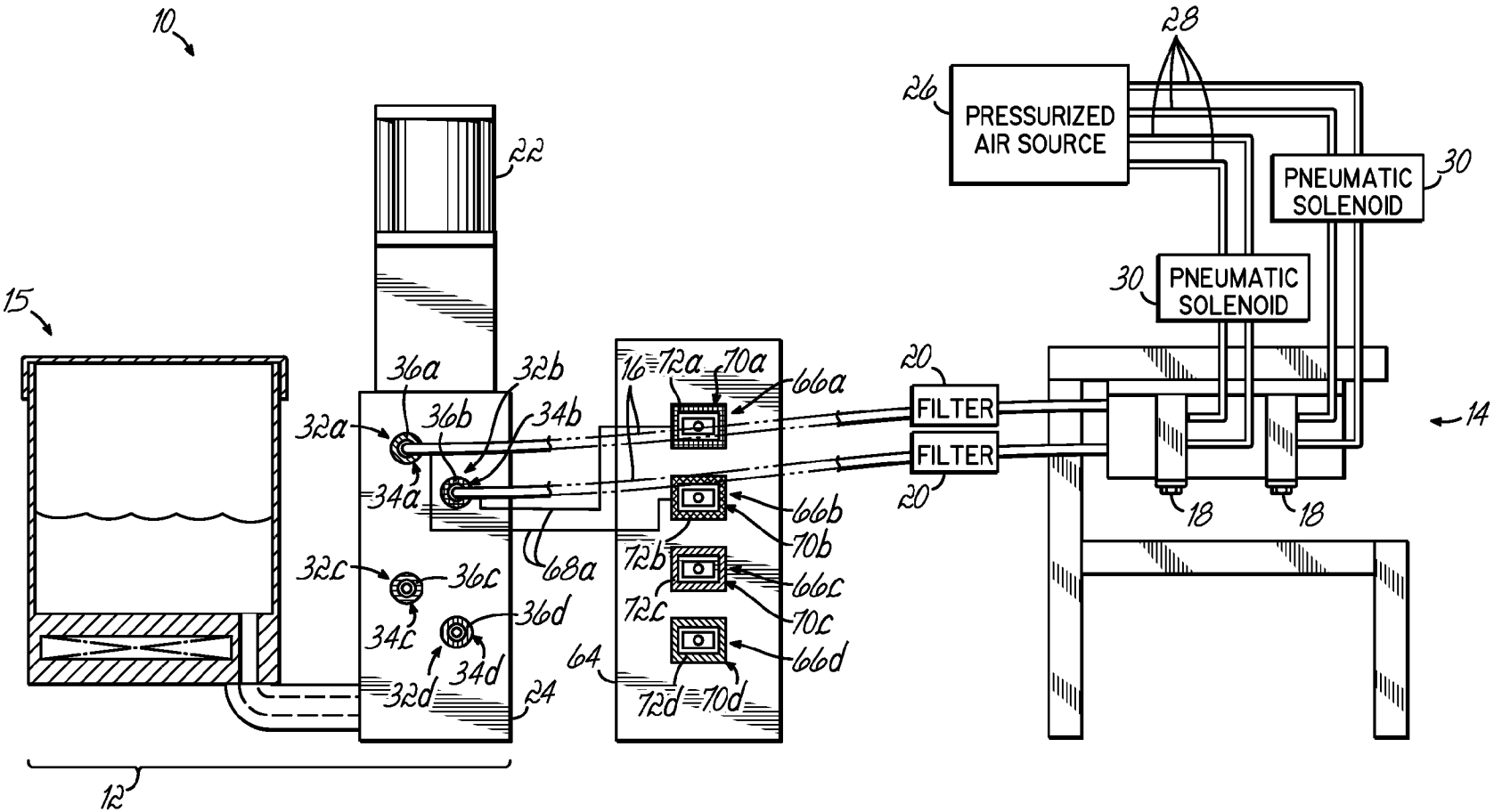
FIG. 1 is a schematic view of an exemplary liquid dispensing system including color-coded visually identifiable indicia in accordance with the principles of the present invention.

Referring now to FIG. 1, an exemplary liquid dispensing system 10, such as a hot melt adhesive dispensing system, is shown incorporating the principles of the present invention. Dispensing system 10 includes a melter unit 12 for holding a supply of hot melt adhesive and heated dispensers or guns 14 (two (2) shown) for dispensing hot melt adhesive supplied from the melter unit 12. The melter unit 12 includes a hot melt supply tank 15 so that hot melt adhesive, in a suitable molten condition, is supplied to the dispensing guns 14 from the tank 15 through heated hoses 16 and is dispensed through dispensing orifices 18 of the guns 14. The hot melt adhesive is supplied from the melter unit 12 to the hoses 16 and through filters 20 to the dispensing guns 14 under the influence of a pump 22 and pump manifold 24 of the melter unit 12. While the present invention will be described in connection with dispensing of hot melt adhesives, those of ordinary skill in the art will appreciate that the present invention is applicable to a wide variety of liquid dispensing systems without departing from the spirit and scope of the present invention.

In one embodiment of the present invention, the dispensing guns 14 may be pneumatically-controlled guns such as those fully described in U.S. Pat. Nos. 4,066,188, 5,277,344 and 5,934,520 previously incorporated herein by reference to which the reader is referred. Briefly, each pneumatically-controlled gun 14 has an internal valve (not shown) which moves relative to a valve seat (not shown) of the dispensing orifice 18 in response to pressurized air supplied from a pressurized air source 26. The valve (not shown) of each gun 14 is positioned in a valve chamber (not shown) within the gun 14 and includes a diaphragm (not shown) that defines an upper air chamber (not shown) above the diaphragm (not shown) and a lower air chamber (not shown) below the diaphragm (not shown). Pressurized air is connected from the pressurized air source 26 to the upper and lower air chambers (not shown) through a pair of air conduits 28 connected to each gun 14. A solenoid 30, well known to those skilled in the art, is provided in the fluid path between the pressurized air source 26 and each gun 14 to control the passage of pressurized air to the upper and lower air chambers (not shown) within each gun 14.

When pressurized air is permitted to pass from the pressurized air source 26 to the lower air chamber (not shown) of the gun 14, the pressurized air forces the diaphragm (not shown) and its associated valve (not shown) away from valve seat (not shown) of the dispensing orifice 18 to permit dispensing of hot melt adhesive from the dispensing orifice 18 of the gun 14. The valve (not shown) is seated relative to the valve seat (not shown) of the dispensing orifice 18 when the solenoid 30 permits pressurized air to pass from the pressurized air source 26 to the upper air chamber (not shown) of the gun 14 which forces the diaphragm (not shown) and its associated valve (not shown) toward the dispensing orifice 18 so that the valve (not shown) seats on the valve seat (not shown) to close the dispensing orifice 18. A spring (not shown) may be provided to assist in the closing action of the valve (not shown). While pneumatically-controlled dispensing guns 14 are described herein, other types of liquid dispensing guns, including electric guns, are possible as well without departing from the spirit and scope of the present invention.

As shown in FIG. 1, each liquid outlet 32*a-d* of the melter unit 12 may include a visually identifiable color-coded indicia 34*a-d* associated with each liquid outlet 32*a-d*. The color-coded indicia 34*a-d* are shown colored, such as by paint, as colored rings 36*a-d* that encircle each respective liquid outlet 32*a-d*. Each color-coded ring 36*a-d* is painted a different color to provide separate visually identifiable indications of the different liquid outlets 32*a-d*. For example, liquid outlets 32*a-d* may be individually color-coded green, yellow, blue and red, respectively, so that each of the liquid outlets 32*a-d* has a unique visually identifiable color-coded indicia associated therewith. Any color-coded designation of the liquid outlets 32*a-d* is contemplated. For example, the color-coded rings 36*a-d* may be replaced with color-coded dots (not shown) or numerals (not shown) such as colored numerals "1", "2", "3" and "4" of different colors so that each liquid outlet 32*a-d* has a unique visually identifiable color-coded indicia associated therewith. Alternatively, the color-coded rings 36*a-d* may comprise color-coded snap-in ring members (not shown) of different colors that are releasably or permanently attached to the melter unit 12 to encircle each liquid outlet 32*a-d* to provide a unique visually identifiable color-coded indicia associated with each liquid outlet 32*a-d*. In yet another alternative embodiment, it is contemplated that each coupling of the liquid outlets 32*a-d* may be color-coded, such as by paint.

Figure 2:
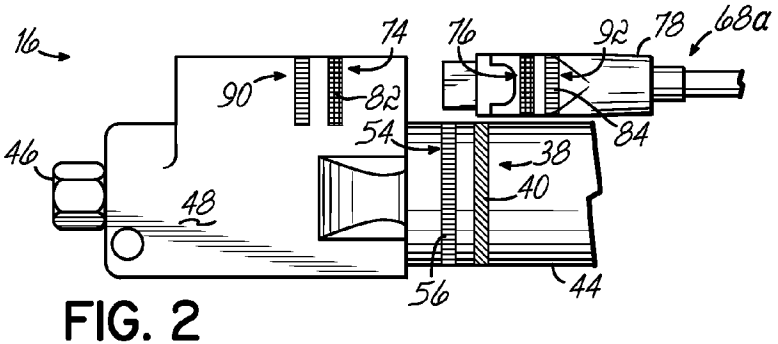
FIG. 2 is an enlarged side elevational view of a hose used in the liquid dispensing system of FIG. 1, illustrating one end of the hose.

As shown in FIG. 2, each hose 16 is provided with a unique visually identifiable color-coded indicia 38 which corresponds to a connection location of the hose 16 to one of the liquid outlets 32*a-d*. The color-coded indicia 38 may be located proximate one or both ends of the hose 16, although other locations are possible as well. For example, each hose 16 may be color-coded with different colors such as green, yellow, blue and red so that each hose 16 has a unique visually identifiable color coded-indicia 38 associated therewith that matches in color with the color-coded indicia 34 of the liquid outlets 32*a-d* of the melter unit 12. The green color-coded indicia 38 indicated by the cross-hatching in FIG. 2 indicates to an operator that the hose 16 is intended to connect with the green liquid outlet 32*a* of the melter unit 12. In this way, the connection location of the multiple hoses 16 typically found in a liquid dispensing line to the liquid outlets 32*a-d* of the melter unit 12 can be readily identified by the operator to assist the operator in proper setup of the dispensing system 10 or during maintenance and diagnostics when the hoses 16 must be reconnected with the melter unit 12 after service or replacement.

Figure 3:
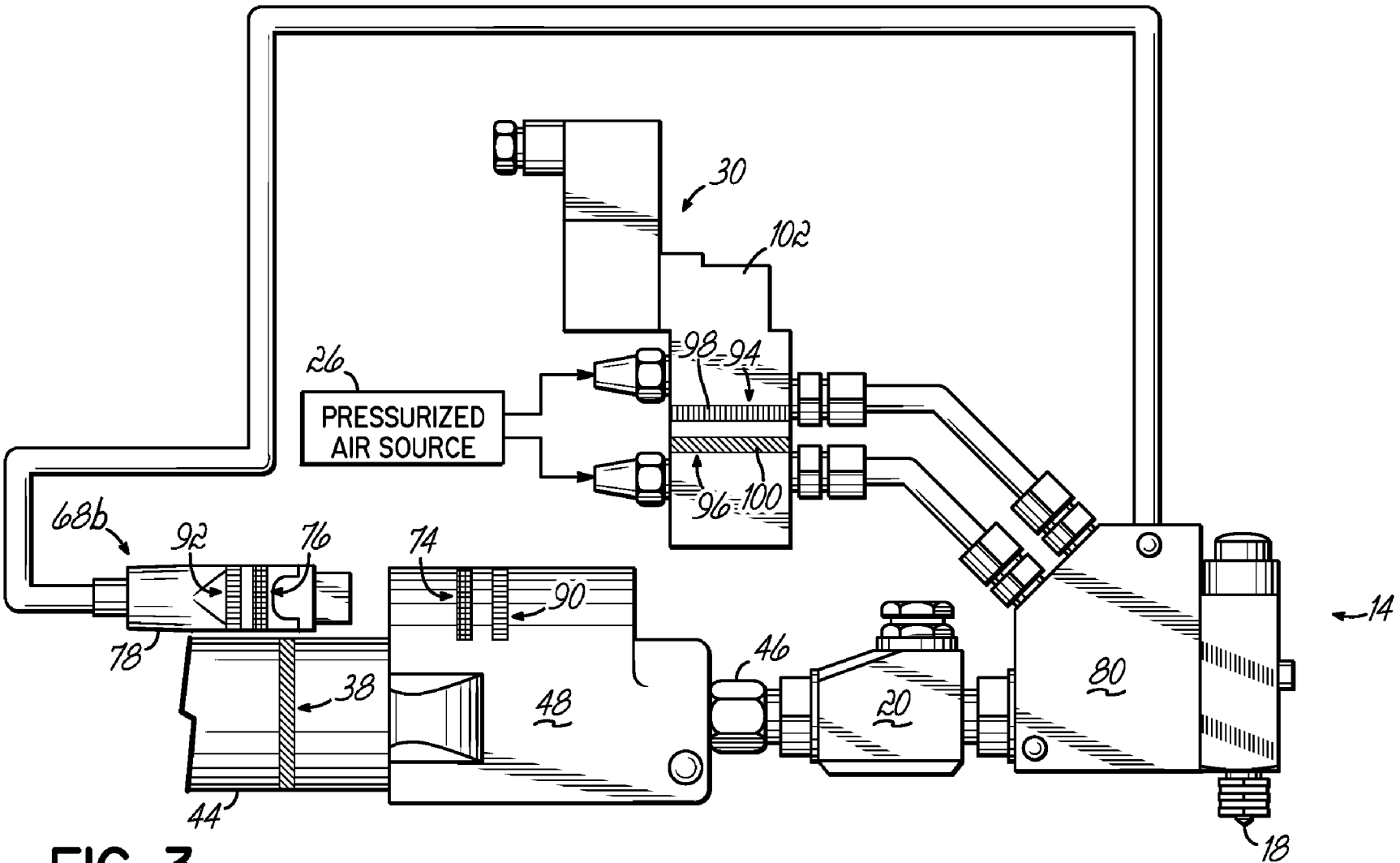
FIG. 3 is a view similar to FIG. 2, illustrating an opposite end of the hose to that hose end illustrated in FIG. 2.

The operator is further assisted in the proper connection of the hoses 16 to the liquid dispensers 14 by providing a separate visually identifiable color-coded indicia, also designated by numeral 38, proximate the dispenser side of the hose 16 as shown in FIG. 3, although other locations are possible as well. The color-coded indicia 38 shown in FIG. 3 matches in color with the color-coded indicia 38 located proximate the melter unit side of the hose 16. In this way, the operator is able to easily identify, through the color-coded indicia 38 at the dispenser side of the hose 16, which dispensing gun 14 the hose 38 should be connected to.

The color-coded indicia 38 which corresponds to the intended connection location of the hose 16 to one of the liquid outlets 32*a-d* of the melter unit 12 is shown colored in FIG. 2, such as by paint, as a colored ring 40 on the surface of the hose sheath 44 and that encircles the body of the hose 16. It will be understood that the hose body includes the various components of the hose 16, including the hose sheath 44, the hose couplings 46 located at opposite ends of the hose 16 and the hose cuffs 48 which may be located at one or both ends of the hose 16. Any color-coded designation of the hoses 16 which corresponds to a connection location of the hose 16 to one of the liquid outlets 32*a-d* is contemplated. For example, as shown in an alternative embodiment of FIG. 2A, the color-coded ring 40 on the hose sheath 44 of FIG. 2 is shown as color-coded ring 40*a* located within a groove 50 formed in the hose sheath 44*a* proximate one or both ends of the hose 16*a*. Alternatively, it will be appreciated that the groove 50 may be provided in the hose cuff 48*a* or in the hose coupling 46*a*. Locating the color-coded ring 40*a* within the groove 50 reduces the likelihood that the ring 40*a* will be worn away during the life of the hose 16.

Figure 2C:
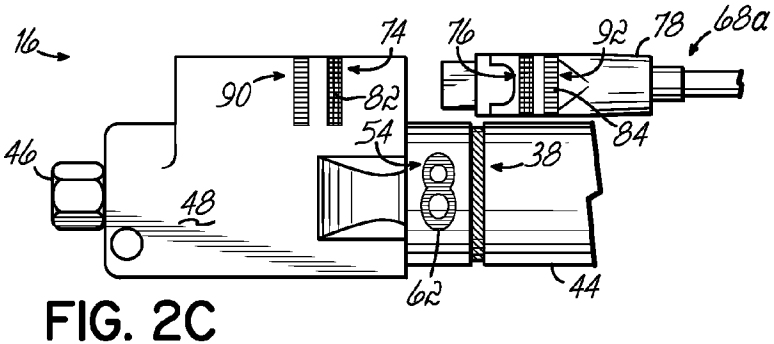
FIG. 2C is a view similar to FIG. 2, illustrating the hose end of FIG. 2.
Figure 2A:
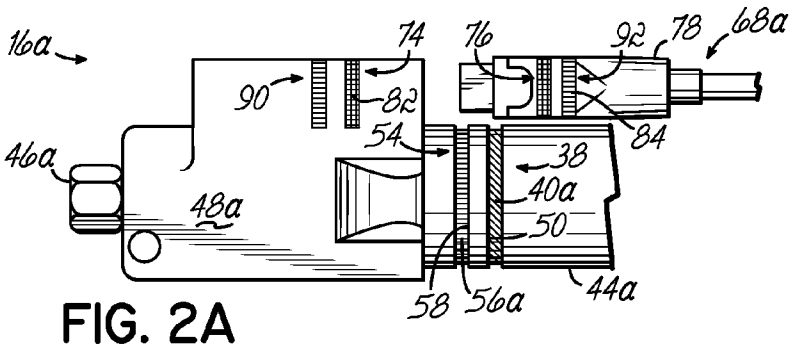
FIG. 2A is a view similar to FIG. 2, illustrating the hose end of FIG. 2.
Figure 2D:
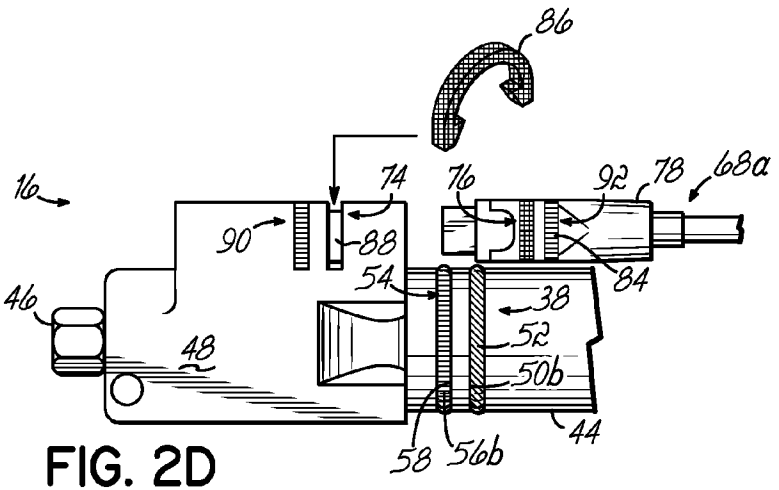
FIG. 2D is a view similar to FIG. 2, illustrating the hose end of FIG. 2.
Figure 2B:
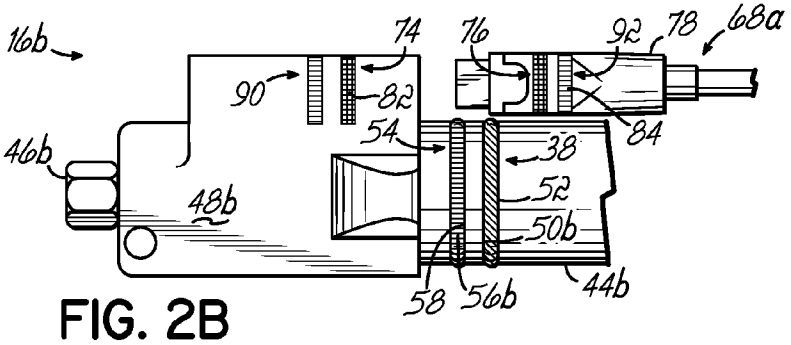
FIG. 2B is a view similar to FIG. 2, illustrating the hose end of FIG. 2.

As shown in the alternative embodiment of FIG. 2B, the color-coded ring 40 on the hose sheath 44 of FIG. 2 is shown as a color-coded ring member 52, such as a colored O-ring or metal retainer ring, which is releasably or permanently located within a groove 50*b* formed in the hose sheath 44*b* proximate one or both ends of the hose 16*b*. In this way, the ring member 52 can be readily changed with a ring member of a different color when the connection location of the hose 16*b* to one of the liquid outlets 32*a-d* is to be changed. Those skilled in the art will appreciate the many configurations of color-coded indicia 38 that are possible to provide a visually identifiable color-coded indication of the intended connection location of the hose 16 with the liquid outlets 32*a-d*.

As shown in FIG. 2, each hose 16 is provided with a visually identifiable color-coded indicia 54 which corresponds to the length of the hose 16. The color-coded indicia 54 may be located proximate one or both ends of the hose 16 (one shown), although other locations are possible as well. For example, each hose 16 may be color-coded yellow for a four (4) foot length, pink for a six (6) foot length, blue for an eight (8) foot length, white for a ten (10) foot length, brown for a twelve (12) foot length and so on so that each hose 16 has a unique visually identifiable color-coded indicia 54 which corresponds to the predetermined length of the hose 16. In this way, the operator is able to easily and quickly select a hose length, or to replace an existing hose 16, simply by referring to the color-coded indicia 54 which corresponds to the hose length. The operator would not even have to know that a blue color-coded indicia 54, as indicated by the cross-hatchings in FIG. 2, corresponds to a eight (8) foot hose, but may simply refer to a hose 16 that has a blue hose length indicia 54 and this will precisely identify the correct hose length for a new or replacement hose 16.

The color-coded indicia 54 which corresponds to the hose length is shown colored in FIG. 2, such as by paint, as a colored ring 56 on the surface of the hose sheath 44 and encircles the hose body in similar fashion to the colored ring 40 corresponding to the hose connection location on the melter unit 12. Any color-coded designation of the hose length is contemplated.

For example, as shown in the alternative embodiment of FIG. 2A, the color-coded ring 56 on the hose sheath 44 of FIG. 2 is shown as a color-coded ring 56 located within a groove 58 formed in the hose sheath 44*a* in similar fashion to the color-coded ring 40 corresponding to the hose connection location on the melter unit 12. Alternatively, the groove 58 may be provided in the hose cuff 48*a* or in the hose coupling 46*a*.

As shown in the alternative embodiment of FIG. 2B, the color-coded ring 56 on the hose sheath 44 of FIG. 2 is shown as a color-coded ring member 60, such as a colored O-ring or metal retainer ring, which is releasably or permanently located within a groove 58*b* formed in the hose sheath 44*b* similar in fashion to the ring member 52 corresponding to the hose connection location on the melter unit 12.

FIG. 2C illustrates another alternative embodiment wherein the color-coded indicia 54 corresponding to the hose length is shown as a color-coded numeral 62, such as a blue numeral "8" by way of illustration, located on the hose sheath 44*c*. Specifically, in this embodiment, the numeral "8" indicates the length of the hose, and the blue color of the numeral corresponds to color-coded length of the hose 16. In this way, an operator may simply refer to the length of the hose 16 as represented by the numeral, such as "8", or, alternatively, the color of the hose 16 as represented by the color of the numeral, such as "blue", and the correct length of hose 16 will be identified during selection of a new hose 16 or replacement of an old hose 16. As with the other color-coded indicia of the present invention described in detail above, those skilled in the art will appreciate the many configurations of color-coded indicia 54 that are possible to provide a visually identifiable color-coded indication of the length of the hose 16.

A shown in FIG. 1, a controller 64 of the liquid dispensing system 10 has multiple electrical connections 66*a-d* for electrically coupling an electrical cordset 68*a* associated with the hose 16 (see FIG. 2) with the controller 64. Each electrical connection 66*a-d* of the controller 64 includes a visually identifiable color-coded indicia 70*a-d* associated with each electrical connection 66*a-d*. The color-coded indicia 70*a-d* are shown colored, such as by paint, as colored rings 72*a-d* that encircle each respective electrical connection 66*a-d*. As with the color-coded rings 36*a-d* on the pump manifold 24, each color-coded ring 72*a-d* is painted a different color to provide separate visually identifiable indications of the different electrical connections 66*a-d*. For example, electrical connections 66*a-d* may be individually color-coded yellow, orange, brown and green, respectively, so that each of the electrical connections 66*a-d* has a unique visually identifiable color-coded indicia associated therewith. Any color-coded designation of the electrical outlets 66*a-d* is contemplated as described in detail above in connection with the color-coded rings 36*a-d* of the pump manifold 24.

As shown in FIG. 2, each hose 16 and electrical cordset 68*a* is provided with a visually identifiable color-coded indicia 74 and 76, respectively, which corresponds to a connection location of the electrical cordset 68*a* to one of the electrical connections 66*a-d* of the controller 64. The color-coded indicia 74 and 76 may be located proximate one or both ends of the hose 16 and on one or both connectors 78 of the electrical cordset 68*a*, although other locations are possible as well. For example, each hose 16 and cordset 68*a* may be individually color-coded yellow, brown, orange and green so that each hose 16 and cordset 68*a* has a unique visually identifiable color coded-indicia 74 and 76, respectively, associated therewith that matches in color with one of the electrical connections 66 and of the controller 64. The yellow color-coded indicia 74 and 76 on the hose 16 and cordset 68*a* indicated by the cross-hatching in FIG. 2 indicates to an operator that the cordset 68*a* is intended to connect with the yellow electrical connection 66*a* of the controller 64. In this way, the connection location of the multiple electrical cordsets 68*a* typically found in a liquid dispensing line to the electrical connections 66*a-d* of the controller 64 can be readily identified by the operator to assist in proper setup of the dispensing system 10 or during maintenance and diagnostics when the cordsets 66*a* must be reconnected with the controller 64 after service or replacement.

As shown in FIG. 3, the operator is further assisted in the proper connection of the electrical cordsets 68*b* to the manifold 80 of liquid dispensers 14 by providing a separate visually identifiable color-coded indicia, also designated by numerals 74 and 76, proximate the dispenser side of the hose 16 and on the connector 78 of the cordset 68*b*. The color-coded indicia 74 and 76 shown in FIG. 3 matches in color with the color-coded indicia 74 and 76 located proximate the melter unit side of the hose 16 and on the connector 78 of the electrical cordset 68*b*, respectively. In this way, the operator is able to easily identify, through the color-coded indicia 74 and 76 at the dispenser side of the hose 16 and on the electrical cordset 68*b*, which dispensing gun 14 the cordset 68*b* should be connected to.

The color-coded indicia 74 and 76 which correspond to the intended connection location of the electrical cordset 68*a* to the electrical connections 66*a-d* of the controller 64 is shown colored in FIGS. 2 and 2A-2C, such as by paint, as a colored band 82 on the surface of the hose cuff 48 and as a colored ring 84 that encircles the connector 78 of the electrical cordset 68*a*. Any color-coded designation of the hoses 16 and electrical cordsets 68*a* and 68*b* which corresponds to a connection location of the cordset 68*a* to one of the electrical connections 66*a-d* of the controller 64 is contemplated. For example, the colored band 82 on the hose cuff 48 and the colored ring 84 on the connector 78 may be provided in grooves (not shown) formed in these components.

In an alternative embodiment as shown in FIG. 2D, the color-coded band 82 on the hose cuff 48 of FIG. 2 is replaced with a color-coded snap-in band member 86 which is releasably or permanently received in a groove 88 formed in the hose cuff 48. In this way, the band member 86 can be readily changed with a band member of a different color when the connection location of the cordset 68*a* to the electrical connections 66*a-d* of the controller 64 is to be changed. Those skilled in the art will appreciate the many configurations of color-coded indicia 74 and 76 that are possible to provide a visually identifiable color-coded indication of the intended connection location of the cordset 68*a* with the electrical connections 66*a-d* of the controller 64.

As is well known in the art, each dispensing gun 14 and hose 16 includes a separate heater which must be within a predetermined temperature range to provide the proper viscosity for the particular hot melt adhesive used in the dispensing application. To monitor the temperature of the hot melt adhesive throughout the dispensing system 10, each hose 16 and dispensing gun 14 includes a temperature sensor (not shown), such as a nickel or platinum resistance temperature device (RTD), which is electrically coupled to the controller 64 through the electrical cordset 68*a* attached to the melter unit side of the hose 16 and by the cordset 68*b* attached to each gun 14. The controller 64 senses the temperature within the dispensing guns 14 and hoses 16 through the respective RTD's (not shown) and operates the heaters (not shown) within the hoses 16 and dispensing guns 14 to maintain the hot melt adhesive within the predetermined temperature range.

As described in detail above, if the RTD type of the hoses 16 and guns 14 are not properly matched to the appropriate, material-specific controller 64, the controller 64 will provide erroneous temperature information about the hot melt adhesive in the hoses 16 and guns 14 and may cause the heating devices within these components to operate improperly.

Each hose 16 and electrical cordset 68*a* and 68*b* may be provided with a visually identifiable color-coded indicia 90 and 92, respectively, which corresponds to the RTD type used in the hoses 16 and guns 14. The color-coded indicia 90 and 92 may be located proximate one or both sides of the hose 16 and on one or both connectors 78 of each cordset 68*a* and 68*b*, although other locations are possible as well. One color may indicate a nickel RTD in the hoses 16 and guns 14 while another color may represent a platinum RTD in the hoses 16 and guns 14. In this way, an operator can readily determine the compatibility of the controller 64 with the RTD's in the hoses 16 and guns 14 simply by looking at the color-coded indicia 90 and 92 on the hoses 16 and cordsets 68*a* and 68*b*. Those skilled in the art will appreciate the many configurations of color-coded indicia 90 and 92 on the hoses 16 and cordsets 68*a*, 68*b* that are possible to provide a visually identifiable color-coded indication of the RTD type within the hoses 16 and guns 14.

As shown in FIG. 3, and in accordance with the principles of the present invention, the solenoid 30, which may be a solenoid used to control pressurized air that operates a pneumatic gun for example, is provided with visually identifiable color-coded indicia 94 and 96 which correspond to operating characteristics of the solenoid 30. For example, color-coded indicia 94 may correspond to an air volume rating of the solenoid while color-coded indicia 96 may correspond to another operating characteristic of the solenoid such as its voltage requirement and/or its temperature rating. For example, the color-coded indicia 96 may designate the solenoid 30 as a 12V or 24V solenoid. Alternatively, the color-coded indicia 96 may represent both the voltage requirement of the solenoid 30 and its temperature rating, such as a 12V or 24V solenoid having either a "low" or "high" temperature rating. Of course, other color-coded designations of the operating characteristics of the solenoid 30 are possible as well. Color-coded indicia 94 and 96 are shown colored in FIG. 3, such as by paint, as colored bands 98 and 100, respectively, on the surface of the solenoid housing 102 which contains the solenoid. Any color-coded designation of an operating characteristic of the solenoid 30 is contemplated by the present invention which may be provided on the surface of the solenoid housing 102 or on the surface of a liquid dispensing gun housing which contains the solenoid, such as with an electric gun. Preferably, where more than one color-coded indicia is used, the color-coded indicia 96 chosen to correspond to one operating characteristic of the solenoid 30 should be different in color than the color-coded indicia chosen to correspond to another operating characteristic of the solenoid. In this way, the color-coded indicia 94 and 96 assist an operator in the proper selection of a solenoid based on its operating characteristics.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, what is claimed is:

1. A method of indicating an operating characteristic of a solenoid used in a liquid dispensing system having a dispensing gun including a valve movable relative to a dispensing orifice of the gun in response to operation of the solenoid, comprising the step of:

providing a first visually identifiable color-coded indicia associated with a housing containing the solenoid that corresponds to one of an air volume capacity or a temperature rating.

2. The method of claim 1 further comprising the step of:

providing a second visually identifiable color-coded indicia associated with the housing that corresponds to an electrical characteristic of the solenoid.

3. The method of claim 2 wherein said first and second visually identifiable color-coded indicia are separate rings of color.

4. A method of indicating an operating characteristic of a solenoid used in the liquid dispensing system having a dispensing gun including a valve movable relative to a dispensing orifice of the gun in response to operation of the solenoid, comprising the steps of:

providing a first visually identifiable color-coded indicia associated with a portion of a housing containing the solenoid and that corresponds to a first characteristic of the solenoid; and providing a second visually identifiable color-coded indicia associated with a different portion of the housing and corresponding to a second characteristic of the solenoid.

5. The method of claim 4 wherein the first and second visually identifiable color-coded indicia are separate rings of color.

6. A solenoid assembly for use in a liquid dispensing system having a dispensing gun including a valve movable relative to a dispensing orifice of the gun in response to operation of the solenoid, the solenoid assembly comprising:

a housing;

a solenoid disposed within said housing;

a first visually identifiable color-coded indicia associated with a portion of said housing and corresponding to a first characteristic of said solenoid; and a second visually identifiable color-coded indicia associated with a different portion of said housing and corresponding to a second characteristic of said solenoid.

7. The solenoid assembly of claim 6 wherein said first and second visually identifiable color-coded indicia are separate rings of color.

8. The solenoid assembly of claim 6 wherein said solenoid has an input for receiving pressurized air and an output for providing pressurized air to said gun in response to an electrical signal.

* * * * *